United States Patent [19]

Wiand

[11] Patent Number: 4,931,069

[45] Date of Patent: Jun. 5, 1990

[54] ABRASIVE TOOL WITH IMPROVED SWARF CLEARANCE AND METHOD OF MAKING

[76] Inventor: Ronald C. Wiand, 18500 Fairway Dr., Detroit, Mich. 48221

[21] Appl. No.: 114,928

[22] Filed: Oct. 30, 1987

[51] Int. Cl.[5] ..... B24D 3/08

[52] U.S. Cl. ..... 51/293; 51/206 R; 51/309

[58] Field of Search ..... 51/206 NF, 206 P, 206 R, 51/209 R, 204, 207, 293, 295, 296, 297, 307, 308, 309

[56] References Cited

U.S. PATENT DOCUMENTS

| | | | |
|---|---|---|---|
| 2,042,635 | 6/1936 | Schellens | 51/296 |
| 2,806,772 | 9/1957 | Robie | 51/296 |
| 3,166,388 | 1/1965 | Riegger | 51/296 |
| 3,615,309 | 10/1971 | Dawson | 51/295 |
| 3,850,590 | 11/1974 | Chalkley et al. | 51/206 NF |
| 3,918,217 | 4/1974 | Oliver | 51/295 |

FOREIGN PATENT DOCUMENTS 622673 5/1949 United Kingdom .

*Primary Examiner*—Frederick R. Schmidt
*Assistant Examiner*—Blynn Shideler
*Attorney, Agent, or Firm*—Harness, Dickey & Pierce

[57] ABSTRACT

An abrasive tool utilizes a bed of discrete elements secured to a tool substrate. The bed of discrete elements provides intersticial spaces between the elements for mounting receipt, for example by brazing, of a monolayer of abrasive particles, such as diamonds. The abrasive particles extend outwardly of the bed to form the abrading elements of the tool.

19 Claims, 1 Drawing Sheet

ABRASIVE TOOL WITH IMPROVED SWARF CLEARANCE AND METHOD OF MAKING

BACKGROUND AND SUMMARY OF THE INVENTION

The present invention relates to abrasive tools. More particularly, the present invention relates to an improved abrasive tool such as a diamond abrasive tool for use in grinding glass.

Abrading tools or devices are used in many fields to grind or abrade material from various work pieces. While abrading processes and tools have been long known, there remains a need for improved tools which abrade efficiently requiring less power and generating less heat.

Accordingly, the present invention provides an abrasive tool having a substrate with a bed of discrete elements with intersticial spaces therebetween secured to a surface of the substrate. A monolayer of a plurality of elongate abrasive particles have their end portions positioned in the interstices and bonded to adjacent elements of the bed. The abrasive particles extend outwardly of the bed and form the abrading elements of the tool.

It is a feature of the invention that an abrasive tool is provided with improved swarf clearance, which, in turn, allows cooler grinding and lower loading.

It is another feature of the invention that the orientation of the abrasive particles allows larger volumetric abraded material displacement with attendant lower pressure and loading during the abrading process.

It is a further feature of the invention that the abrasive tool allows for fast material removal rates with low power requirements.

It is yet a further feature of the invention that the abrasive tool provides reduced workpiece-to-tool surface contact and improved coolant flow characteristics to provide improved lubricity.

It is still a further feature of the invention that the abrasive tool provides excellent retention of the abrasive particles.

Further understanding of the present invention will be had from the accompanying drawings and following disclosure. As used herein, all percentages and parts are by weight unless otherwise indicated.

DESCRIPTION OF THE PREFERRED EMBODIMENTS

Figure 1:
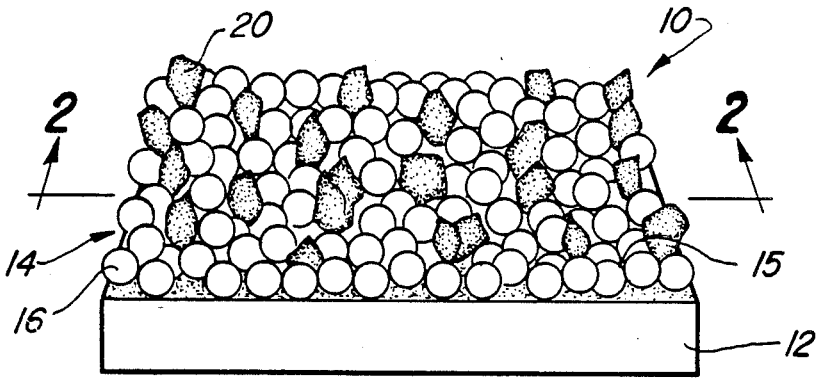
FIG. 1 is a perspective view, broken away, of an abrading surface of an abrasive tool arranged in accordance with the principles of the present invention.
Figure 2:
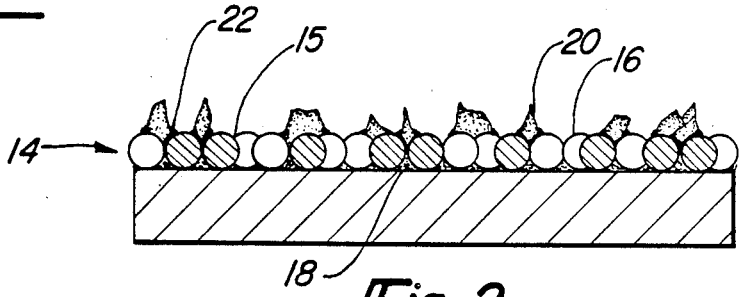
FIG. 2 is a cross-sectional view of the abrading surface of FIG. 1 taken along line 2—2 in FIG. 1.

Now referring to FIGS. 1 and 2, a preferred embodiment of an abrasive tool of the present invention is shown and indicated generally by the numeral 10.

Abrasive tool 10 has a steel substrate 12 with a bed 14 of generally spherical steel balls 16 brazed onto substrate 12 by means of braze 18. Bed 14 has a plurality of intersticial spaces 15 between balls 16. A plurality of diamond abrasive particles 20 are positioned in some of the intersticial spaces 15 and brazed with braze 22 to adjacent balls 16.

Figure 3:
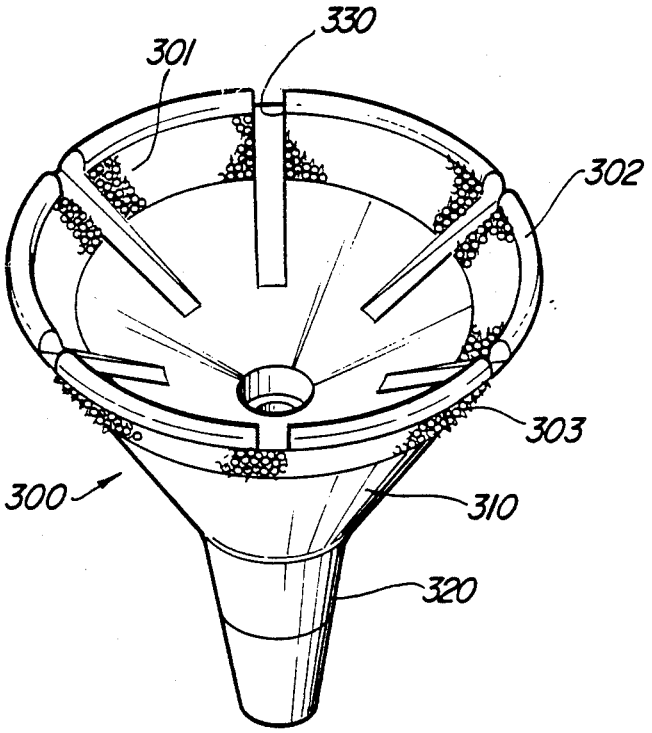
FIG. 3 is a perspective view of a toric curve generating wheel for use on ophthalmic lenses, the generating wheel arranged in accordance with the principles of the present invention.
Figure 4:
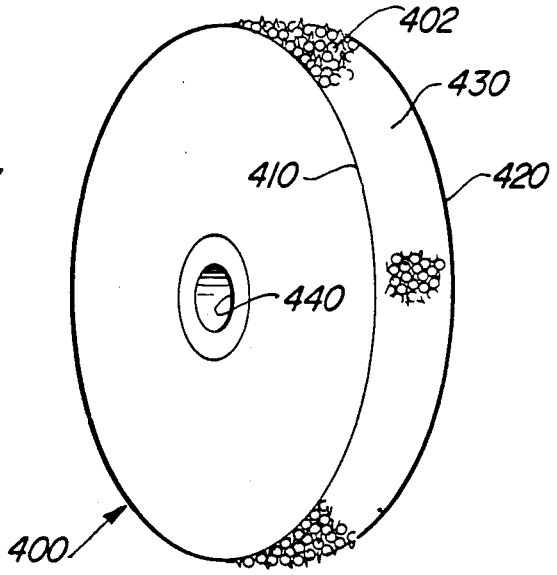
FIG. 4 is a perspective view of a roughing wheel for use on ophthalmic lenses and arranged in accordance with the principles of the present invention.

Two illustrative examples of grinding tools incorporating the abrading surface described above with reference to FIGS. 1 and 2 are set forth in FIGS. 3 and 4.

FIG. 3 is a perspective view of a toric curve generating wheel used in shaping ophthalmic lenses. Generating wheel 300 has a hollow, funnel-like conical steel head portion 310 joined to a mounting shank 320. Head 310 additionally includes a plurality of coolant and swarf conducting channels 330. At the end of the hollow conical head, abrading surfaces 301, 302 and 303 are secured to the generating wheel. Inner cutting surface 301 and outer cutting surface 303 are each arranged as described for the abrading surface of FIGS. 1 and 2, that is, the steel substrate of the wheel carries a bed of generally spherical balls attached to the substrate by brazing, for example. The bed of balls presents a plurality of intersticial spaces between the balls for receipt of diamond abrasive particles, also brazed to adjacent ball surfaces surrounding the interstice carrying the abrasive particle. Preferably, the substrate carrying surfaces 301 and 303 are slightly recessed prior to the deposition of the ball bed in order to more easily maintain the balls in a desired mounting position.

Radiused cutting surface 302 of wheel 300 joins inner and outer surfaces 301 and 303, respectively, but preferably does not carry a bed of interstices-generating balls, due to tight tolerance requirements placed on the radiused form of abrading region 302.

FIG. 4 is a perspective view of a roughing wheel, also used in shaping ophthalmic lenses. Roughing wheel 400 is comprised of a steel cylindrical body having an axial mounting hole 440 and an abrasive surface 402 arranged as described above in conjunction with FIGS. 1 and 2. Abrading surface 402 is affixed, such as by brazing, to mounting steel substrate surface 430 extending about the outer circumferential surface area of the cylindrical wheel. Wheel sidewalls 410 and 420 are preferably slightly raised above surface 430 prior to deposition of the bed of balls for easier maintenance of the location of the balls prior to their rigid bonding to the substrate surface.

Generally speaking, an abrasive tool of the present invention comprises a bed of discrete elements with intersticial spaces therebetween secured to a surface of a substrate. A monolayer of a plurality of elongated abrasive particles is secured to the bed with end portions of the particles positioned in the interstices between discrete elements of the bed. The abrasive particles are bonded to adjacent elements of the bed and are of sufficient length to extend outwardly from the bed so as to come into contact with a workpiece.

The elongated abrasive particles are oriented with end portions extending downwardly into the interstices between discrete elements of the bed. This serves to orient the abrasive particles along their longest axis to provide larger volumetric displacement in the abrading process with attendant lower abrading pressure and lower loading requirements during abrading. In addition the bed provides improved swarf clearance with attendant improved use of coolant to provide less heat buildup during abrading and decrease loading of the tool by the workpiece during abrading. Still further the bed provides reduced surface area for contact with the workpiece. This improves lubricity, and reduces the power required during the abrading process. The abrading tools of the present invention have excellent material removal rates and retention of abrasive particles.

Suitable substrates for use herein will be well known to those skilled in the art. While the present invention is particularly well adapted for use in the optical industry, other abrading tools are within the broad scope of the present invention. Thus while suitable substrates can be those substrates useful for optical roughing wheels, generating wheels, hand edging wheels, or bevel edging wheels, other substrates useful for industrial wheels such as peripheral wheels, face wheels and form wheels, can also be used. Glass grinding outer diameter wheels and pencil edging wheels are also within the scope of the present invention. The substrate can comprise steel or any other material suitable for use herein.

The bed of discrete elements can be provided by any elements having a geometric shape suitable to provide the required intersticial spaces for reception of the elongated abrasive particles. Preferred discrete elements are spherical elements such as steel balls or ball bearings. For example, the spherical elements may be comprised of steel, copper, bronze, ceramic, graphite, tungsten carbide, or other suitable material. While a broad range of sizes of elements may be suitable depending upon the particular use of the abrading tool, it will be appreciated that the elements must be sized so that the elongated abrasive particles will extend beyond the plane defined by the outer surface of the spherical elements.

A wide variety of elongated abrasive particles can be used in accordance with the present invention. Thus, suitable abrasive particles for use herein include abrasive particles comprised of silicon carbide, tungsten carbide, aluminum oxide, garnet, cubic boron nitride, and synthetic or natural diamond. Preferably the abrasive particles are diamond particles. The diamond particles may be natural or synthetic diamond and can be coated or uncoated. Preferably the abrasive particles have an aspect ratio substantially greater than one, for example 1.5 to 1.

Where the abrasive tool is an ophthalmic roughing wheel, discrete elements having a size or diameter of from about 0.010 to about 0.030 inches and diamond of from about 18/20 to about 80/100 mesh will suitable for use herein. Preferably spherical elements having a diameter of about 0.025 inches are used with diamond particles of 40/50 mesh. Where the abrasive tool is an ophthalmic generating wheel, spherical elements having a size of from about 0.060 to about 0.030 inches and diamond particles having a size of from about 18/20 to about 40/60 mesh will be suitable. Preferably spherical elements having a size of about 0.040 inches and diamond particles having a size of 18/20 mesh are used.

Broadly speaking spherical elements having a size of from about 0.005 to about 0.125 could be used in the present invention. Abrasive particles having a size of from about 1 mesh to about 400 mesh will be suitable for use herein.

The spherical elements are bonded to the substrate and the abrasive particles are bonded to the spherical elements by any suitable means. Preferably the bonding is accomplished by means of brazing. One suitable braze is NICROBRAZ L.M. available commercially from the Wall Colmonoy Corporation. Another brazing compound suitable for use in practicing the invention is comprised of about 10% iron, about 4.1% silicon, about 2.8% boron and about 83.1% nickel. Suitable brazes are well known in the art. Other bonding methods may be used, such as electroplating.

Further understanding of the present invention will be had from the following examples.

EXAMPLE 1

A toric curve generating wheel core for ophthalmic lenses having a recessed surface to constrain spherical balls is coated with a monolayer of 0.040 inch diameter steel balls on the abrading surface thereof. The balls are positioned with a braze in a paste. Wall Colmonoy L.M. braze in Wall Colmonoy "S" binder is used. A braze/-paste mixture is then allowed to dry.

The coated substrate is then placed in a vacuum furnace and heated to about 1885° Fahrenheit under a vacuum of $10^{-4}$ torr for about 600 seconds. The braze melts and flows and wets the balls and substrate. The coated substrate is then allowed to cool under vacuum to about 350° Fahrenheit and additional braze/paste mixture is brushed onto the abrading surface. Natural diamond particles of 20/25 mesh are then sprinkled onto the surface and the braze and paste are allowed to dry. The diamond particles have an aspect ratio of about 1.5. The coated tool is then heated under vacuum of $10^{-4}$ torr to about 1885° Fahrenheit for about 600 seconds. The braze again melts and flows and wets the diamond and the balls. The tool is then allowed to cool to room temperature.

The resulting tool has excellent abrading properties.

EXAMPLE 2

A tool is made as in Example 1 except that a roughing wheel core is used instead of a diamond generator wheel core and steel balls having a size of 0.025 inches are used and diamond abrasive particles of 18/20 mesh with an aspect ratio of 1.2 are used to make a diamond roughing wheel of the present invention.

What is claimed is:

1. An abrasive tool comprising:

(a) a substrate;

(b) a bed of discrete elements with intersticial spaces therebetween secured to a surface of said substrate; and (c) a monolayer of a plurality of elongated abrasive particles, each of said abrasive particles having an end portion positioned in one of said intersticial spaces, said end portion bonded to elements of said bed adjacent thereto, each of said abrasive particles being oriented in said intersticial space by said adjacent elements to have an opposite end portion extending outwardly from said bed.

2. The tool of claim 1 wherein the discrete elements each present a substantially spherical surface facing away from the substrate.

3. The tool of claim 2 wherein the discrete elements comprise substantially spherical balls secured to the substrate surface.

4. The tool of claim 3 wherein said bed comprises a monolayer of said balls, said balls are secured to a surface of said substrate by brazing and said abrasive particles are bonded to adjacent balls by brazing.

5. The tool of claim 1 wherein the substrate comprise a metal.

6. The tool of claim 1 wherein each elongated abrasive particle is selected from the group comprising silicon carbide, tungsten carbide, oxide, garnet, cubic boron nitride, natural diamond and synthetic diamond.

7. The tool of claim 1 wherein each elongated abrasive particle has an aspect ratio from about 1.0 to about 1.5.

8. The tool of claim 1 wherein the bed of discrete elements is secured to the substrate surface by brazing.

9. The tool of claim 1 wherein the elongated abrasive particles are bonded to adjacent elements of the bed by brazing.

10. A method for making an abrasive tool comprising the steps of:

placing a monolayer of abutting discrete elements with intersticial spaces therebetween on a substrate surface with a bonding agent;

treating the layered substrate so as to enable the bonding agent to secure the monolayer to the substrate surface;

coating the monolayer of discrete elements with additional bonding agent;

sprinkling a monolayer of a plurality of elongated abrasive particles onto the monolayer of discrete elements such that end portions of the abrasive particles are positioned in the interstices between discrete elements, each of said abrasive particles being oriented by one of said interstices to have an opposite end portion extending outwardly from said bed; and treating the abrasive particle monolayer so as to enable the additional bonding agent to secure the abrasive particles to adjacent discrete elements.

11. The method of claim 10 wherein the bonding agent comprises a braze in a paste.

12. The method of claim 11 wherein the discrete elements each present a substantially spherical surface facing away from the substrate.

13. The method of claim 12 wherein the discrete elements comprise substantially spherical balls.

14. The method of claim 10 wherein the substrate comprises a metal.

15. The method of claim 14 wherein the substrate comprises steel.

16. The method of claim 10 wherein each elongated abrasive particle is selected from the group comprising silicon carbide, tungsten carbide, aluminum oxide, garnet, cubic boron nitride, natural diamond and synthetic diamond.

17. The method of claim 10 wherein each elongated abrasive particle has an aspect ratio from about 1.0 to about 1.5.

18. A method of making an abrasive tool comprising:

placing a monolayer comprised of a plurality of steel balls on a steel substrate and positioning the balls with a braze in a paste;

allowing the braze/paste mixture to dry;

placing the monolayered substrate in a vacuum furnace and heating at a temperature and for a time sufficient to cause the braze to melt and wet the balls and substrate;

cooling the monolayered substrate under vacuum;

brushing additional braze/paste mixture onto the monolayered surface;

sprinkling the monolayered surface with a plurality of elongated diamond particles;

allowing the braze/paste to dry;

heating the diamond particle-steel ball-substrate combination in a vacuum furnace at a temperature and for a time sufficient to cause the braze to melt and wet the diamond particles and the balls; and cooling the combination to room temperature.

19. The method of claim 18 further comprising the preliminary step of recessing the steel substrate so as to constrain the steel balls prior to the heating of the braze/paste mixture.

* * * * *

UNITED STATES PATENT AND TRADEMARK OFFICE

CERTIFICATE OF CORRECTION

PATENT NO. : 4,931,069

DATED : June 5, 1990

INVENTOR(S) : Ronald C. Wiand

It is certified that error appears in the above-identified patent and that said Letters Patent is hereby corrected as shown below:

Column 3, line 46, after "will" insert --be--.

Column 3, line 57, after "0.125" insert --inches--.

Column 4, line 63, "comprise" should be --comprises--.

Column 4, line 67, before "oxide" insert --aluminum--.

Signed and Sealed this

Thirteenth Day of October, 1992

*Attest:*

DOUGLAS B. COMER

*Attesting Officer*

*Acting Commissioner of Patents and Trademarks*